US009937374B2

(12) United States Patent
Leary

(10) Patent No.: US 9,937,374 B2
(45) Date of Patent: Apr. 10, 2018

(54) ATHLETIC TRAINING BOOT

(71) Applicant: Stephone Leary, Houston, TX (US)

(72) Inventor: Stephone Leary, Houston, TX (US)

( * ) Notice: Subject to any disclaimer, the term of this patent is extended or adjusted under 35 U.S.C. 154(b) by 0 days.

(21) Appl. No.: 15/259,972

(22) Filed: Sep. 8, 2016

(65) Prior Publication Data

US 2018/0036577 A1 Feb. 8, 2018

Related U.S. Application Data

(60) Provisional application No. 62/369,969, filed on Aug. 2, 2016.

(51) Int. Cl.

| | |
|---|---|
| ***A63B 21/065*** | (2006.01) |
| ***A43B 3/02*** | (2006.01) |
| ***A43B 13/22*** | (2006.01) |
| ***A43B 3/00*** | (2006.01) |
| ***A43B 13/36*** | (2006.01) |

(Continued)

(52) U.S. Cl.

CPC ..... *A63B 21/065* (2013.01); *A43B 3/0005* (2013.01); *A43B 3/0031* (2013.01); *A43B 3/02* (2013.01); *A43B 13/223* (2013.01); *A43B 13/36* (2013.01); *A43C 11/1493* (2013.01); *A43C 15/16* (2013.01); *A63B 21/00061* (2013.01); *A63B 21/0407* (2013.01); *A63B 21/0552* (2013.01); *A63B 21/0557* (2013.01); *A63B 21/0604* (2013.01); *A63B 23/04* (2013.01); *A63B 24/0062* (2013.01); *A63B 24/0075* (2013.01); *A63B 2220/803* (2013.01); *A63B 2220/836* (2013.01); *A63B 2225/54* (2013.01)

(58) Field of Classification Search

CPC ..... A63B 21/065; A63B 21/0603; A63B 21/4011; A63B 21/4015; A63B 21/4013; A63B 2208/0204; A63B 21/4025

USPC ..... 482/105

See application file for complete search history.

(56) References Cited

U.S. PATENT DOCUMENTS 818,173 A * 4/1906 Hoffman ..... A43B 3/20 36/130

2,214,052 A 9/1940 Good (Continued)

FOREIGN PATENT DOCUMENTS

| | | |
|---|---|---|
| GB | 509726 A | 7/1939 |
| GB | 2247181 A | 2/1992 |
| WO | 2004085005 A2 | 10/2004 |

OTHER PUBLICATIONS

"Rancho," Punitive Shoes, punitiveshoes.com, Dec. 9, 2003. https://web.archive.org/web/20031209165130/http://www.punitiveshoes.com/database/ballets/rancho.shtml 1 page.

(Continued)

*Primary Examiner* — Andrew S Lo

(74) *Attorney, Agent, or Firm* — Charles Knobloch

(57) ABSTRACT

A training boot having a half-platform sole, a boot upper disposed on the half-platform sole, and a weight housing disposed on the upper. A receptacle fastening member is disposed on the boot, configured and arranged for attaching a resistance band. The sole has a tread, which is interchangeable. A sensor housing is disposed on or in the boot. A heel strap is attached to the boot. Hooks or rings are attached to the half-platform sole, configured and arranged for attaching a resistance band. A training boot system includes two training boots with a resistance band removably attaching to the two boots.

37 Claims, 5 Drawing Sheets

(51) Int. Cl.

| | |
|---|---|
| ***A43C 11/14*** | (2006.01) |
| ***A43C 15/16*** | (2006.01) |
| ***A63B 21/04*** | (2006.01) |
| ***A63B 21/055*** | (2006.01) |
| ***A63B 21/00*** | (2006.01) |
| ***A63B 21/06*** | (2006.01) |
| ***A63B 24/00*** | (2006.01) |
| ***A63B 23/04*** | (2006.01) |

(56) References Cited

U.S. PATENT DOCUMENTS

| | | | | |
|---|---|---|---|---|
| 2,292,770 | A * | 8/1942 | Platkin | A43B 3/16 36/7.2 |
| 3,306,610 | A | 2/1967 | Biggs, Jr. et al. | |
| 3,324,579 | A * | 6/1967 | Steininger | A43C 13/14 36/7.2 |
| 3,366,380 | A | 1/1968 | Montour | |
| 3,739,500 | A | 6/1973 | Cox | |
| 4,777,743 | A * | 10/1988 | Roehrig, Jr. | A43B 3/0031 36/132 |
| 4,896,879 | A | 1/1990 | Klawitter | |
| 4,941,273 | A | 7/1990 | Gross | |
| 4,958,445 | A | 9/1990 | Brisco | |
| 5,317,822 | A * | 6/1994 | Johnson | A43B 13/36 36/101 |
| 5,339,542 | A | 8/1994 | Kim | |
| 5,471,767 | A * | 12/1995 | Walker | A43B 7/02 126/204 |
| 5,694,706 | A | 12/1997 | Penka | |
| 5,752,330 | A | 5/1998 | Snabb | |
| 5,893,223 | A | 4/1999 | Glass | |
| 5,938,572 | A * | 8/1999 | Spano | A63B 21/0603 482/105 |
| 5,996,258 | A * | 12/1999 | Simmons | A43C 13/14 36/7.1 R |
| 6,052,924 | A * | 4/2000 | Sabat | A43B 3/0031 36/132 |
| 6,171,220 | B1 * | 1/2001 | Lumpkin | A63B 21/065 482/105 |
| 6,286,234 | B1 * | 9/2001 | Smith, Jr. | A43C 13/14 36/131 |
| D450,175 | S * | 11/2001 | Lofley | D2/909 |
| 6,312,361 | B1 | 11/2001 | Hayes | |
| 6,345,454 | B1 * | 2/2002 | Cotton | A43B 3/24 36/101 |
| 6,397,498 | B1 | 6/2002 | Yoo | |
| D470,647 | S * | 2/2003 | Johnson | D2/913 |
| D479,905 | S * | 9/2003 | Wright | D2/946 |
| 6,944,976 | B2 * | 9/2005 | Sapp | A43B 5/18 36/100 |
| 7,246,453 | B2 * | 7/2007 | Kim | A43B 5/00 36/100 |
| 7,278,227 | B2 | 10/2007 | Masoodifar | |
| 7,451,557 | B2 * | 11/2008 | McDonald | A43B 1/0063 36/100 |
| 7,607,243 | B2 * | 10/2009 | Berner, Jr. | A43B 3/0005 36/136 |
| 7,618,356 | B1 | 11/2009 | Johnson et al. | |
| 7,721,466 | B2 * | 5/2010 | Guo | A43B 13/36 36/15 |
| 8,112,910 | B2 * | 2/2012 | Herber | A43B 5/185 36/129 |
| 8,458,927 | B2 | 6/2013 | Santos | |
| 8,622,879 | B1 | 1/2014 | Ihli et al. | |
| 8,984,777 | B1 * | 3/2015 | Garcia-Osuna Polanco | A43B 5/00 36/114 |
| 2006/0090372 | A1 | 5/2006 | Kim | |
| 2006/0174522 | A1 | 8/2006 | Yu | |
| 2006/0189460 | A1 | 8/2006 | Katterjohn | |
| 2009/0131233 | A1 * | 5/2009 | Seitzer | A63B 21/4015 482/105 |
| 2010/0050473 | A1 | 3/2010 | Rosso | |
| 2013/0067767 | A1 | 3/2013 | Casto | |
| 2014/0336012 | A1 | 11/2014 | Gourineni | |
| 2015/0305439 | A1 | 10/2015 | Moorer et al. | |
| 2016/0038788 | A1 * | 2/2016 | McMillan | G01L 5/18 73/488 |

OTHER PUBLICATIONS

"Do Strength Shoes Improve Your Vertical? The Truth," The Unguardable, theunguardables.com, Dec. 6, 2012. https://web.archive.org/web/20121206010707/http://theunguardables.com/do-strengthshoes-improve-your-vertical-the-truth/ 8 pages.

"SKLZ—Shoe Weights: Weighted Comfort-Fit Trainers," KO Sports, shop.sklz.com, reference: KO_S1416, Dec. 19, 2015. http://web.archive.org/web/20151219054001/http://www.ko-sports.co.uk/product/sklzshoe-weights 2 pages.

"Muscle Trainer Weighted Shoes," active forever, activeforever.com, SKU: A16161 03, Sep. 9, 2015. https://web.archive.org/web/20150909004532/https://www.activeforever.com/muscletrainer-weighted-shoes 3 pages.

"Lateral Resistor Pro: Strength and Speed Trainer," SKLZ, shop.sklz.com, Jun. 10, 2015. https://web.archive.org/web/20150610001058/http://shop.sklz.com/lateral-resistorpro/invt/apdlrxg01 8 pages.

"Iron Boots & Course," Atomic® Athletic, atomicathletic.com, Sep. 2, 2013. http://web.archive.org/web/20130902122026/http://atomicathletic.com/store/index.php/iron-boots-course.html 5 pages.

* cited by examiner

ATHLETIC TRAINING BOOT

CROSS REFERENCE TO RELATED APPLICATIONS

This application claims the benefit of U.S. Provisional Application 62/369,969 of filing date Aug. 2, 2016.

BACKGROUND OF THE INVENTION

1. Field of the Invention

Examples of the subject matter disclosed herein generally relate to apparatus, methods, and systems attached to the foot for exercise and therapeutic purposes.

2. Discussion of Background

The present invention relates to developments in footwear devices for exercise and/or therapeutic purposes.

U.S. Pat. No. 7,278,227 to Masoodifar discloses a Conditioning Shoe And Method Of Use: the conditioning article of footwear for exercise, strength training, or physical therapy having a foot support platform with either straps or an upper shoe portion or the like to engage the foot, a sole having front and rear ends corresponding with the toes and heel of the foot, respectively, and a medial area there between, the sole having a spaced medial support portion having floor engaging surface generally parallel to the foot support platform, the medial support portion situated generally under the ball and (generally) arch of the user's foot. Masoodifar fails to disclose a weight housing disposed on the boot upper, a boot upper of a mesh material, a heel strap in connection with the front bottom sole, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

U.S. Pat. No. 4,896,879 to Klawitter discloses an Adjustable Weight Device For Human Joint Or Muscle Exercise: an adjustable boot-shaped weight for exercising a human joint or muscle group, such as a knee, by strapping onto the foot and filling the container with liquid or other flowable material in the hollow body of the device. The ball of the foot extends beyond the base of the container, and the concave leg support partially surrounds the back portion of the leg while extending above the ankle to prevent slipping. The retainers over the instep and the lower leg keep the leg in place while the lining provides comfort for the user. Klawitter fails to disclose a sole extending in the location of the ball of a foot with a greater thickness than any sole extending in the location of the heel of the foot, a boot upper of a mesh material, a heel strap in connection with the front bottom sole, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

U.S. Pat. No. 2,214,052 to Good discloses an Exercising Boot: exercising devices in the form of boots, preferably of metal for desired weight, arranged to be secured to the feet, with provision for adding weights to increase the muscular exertion required in body developing leg movements. Good fails to disclose a sole extending in the location of the ball of a foot with a greater thickness than any sole extending in the location of the heel of the foot, a boot upper, a boot upper of a mesh material, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

U.S. Pat. No. 3,366,380 to Montour discloses a Weighted Ankle Band: comprising a flexible outer band with a plurality of lace hooks positioned transversely across opposite end portions thereof, a flexible inner band secured to said outer band and having a plurality of pockets disposed transversely throughout the length thereof, said inner band having a depending portion between each of its ends and its midportion, which depending portions are outside the confines of said outer band, said depending portions being shaped to provide generally inverted V-shaped notches at said midportion and at said ends when such ends are in abutting relationship, loop means secured to each of said depending portions adjacent to the ends of said inner band, a lace fitting through said loop means and adapted to fit under the arch of the wearer of the ankle band and to be fitted through said hooks, and weights carried in said pockets. Montour fails to disclose a sole extending in the location of the ball of a foot with a greater thickness than any sole extending in the location of the heel of the foot, a boot upper of a mesh material, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

US Publication 2006/0090372 to Kim discloses a Shoe Replicating Benefits Of Mountain Climbing: comprising a pair of shoes for maintaining the elevation of a mountain for a wearer even while walking on a plane (street). The shoes have a front sole that is much higher than the heel. The front sole is developed in a distorted trapezoidal form. The upper side of the front sole, the longest side of the sole, is adhered to an upper, which carries the wearer's foot, from the waist of the shoe to the toe portion thereof. One of the sides of the front sole that faces the heel direction of the shoe is in a convex arcuate shape. Kim fails to disclose a weight housing disposed on the boot upper, a boot upper of a mesh material, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

U.S. Pat. No. 5,694,706 to Penka discloses a Heelless Athletic Shoe: comprising an upper and multiple part sole. An inner sole engages the plantar surface of a foot. A shock absorbing midsole underlies the inner sole from a location underlying the toes to a location at the base of a heel of the foot. An outer sole includes a first portion under the forefoot to provide a second shock absorbing layer and to define a landing surface. A thin, relatively rigid portion underlies the heel and corresponding portion of the inner sole to support the heel. This portion is elevated above the landing surface to inhibit heel landings and strikes. Penka fails to disclose a weight housing disposed on the boot upper, a receptacle fastening member disposed on the boot that is configured and arranged for attaching a resistance band, a sensor housing disposed on the boot upper, a sensor housing that is configured and arranged to receive interchangeable sensors, a sensor housing disposed in the front bottom sole, an interchangeable tread on the bottom of the sole, a training boot system of two training boots as described herein, with a resistance band or cord attaching the two boots.

U.S. Pat. No. 6,397,498 to Yoo discloses a Sports Shoes For Training Physical Strength: the shoe divided into the uppers, middle layer of a shoe sole, and the bottom sole. A rubber seat is inserted at both sides and the back of the uppers; a high-elastic sponge is adhered at bottom surface of the middle layer; and, a plurality of holes are widely distributed at the upper surface of the bottom sole, with springs engaged in each hole, with a first space and a second space shaped to the fore and the back of the bottom sole, with metal tubes engaged with given intervals in the first and second spaces, and polyurethane charged between the metal tubes. Yoo fails to disclose a sole extending in the location of the ball of a foot with a greater thickness than any sole extending in the location of the heel of the foot, a boot upper of a mesh material, a receptacle fastening member disposed on the boot that is configured and arranged for attaching a resistance band, a weight housing disposed on the boot upper, a sensor housing disposed on the boot upper, a sensor housing that is configured and arranged to receive interchangeable sensors, a sensor housing disposed in the front bottom sole, a plurality of attachment rings or hooks disposed on the front bottom sole, an interchangeable tread on the bottom of the sole, a training boot system of two training boots as described herein, with a resistance band or cord attaching the two boots.

US Publication 2014/0336012 to Gourineni discloses Achilles Stretching Devices And Methods Performed Therewith: each device includes base and wedge portions. The wedge portion has heel and toe ends, inside-foot and outsidefoot edges, and an upper surface that includes a planar surface portion that lies in a wedge plane and an arcuate surface portion defined by a projection that extends out of the wedge plane. The wedge plane has a nonuniform elevation relative to the base portion as a result of the wedge portion having a fore-aft taper in the fore-aft direction and a lateral taper in the lateral direction. The fore-aft taper and the lateral taper are sufficient so that placement of a user's foot on the upper surface of the wedge portion causes supination and locking of the foot and enables stretching of the Achilles complex, while the arch of the user's foot is against and supported by the arcuate surface portion. Gourineni fails to disclose a boot, a boot upper of a mesh material, a heel strap in connection with the front bottom sole, a receptacle fastening member disposed on the boot that is configured and arranged for attaching a resistance band, a weight housing disposed on the boot upper, a sensor housing disposed on the boot upper, a sensor housing that is configured and arranged to receive interchangeable sensors, a sensor housing disposed in the front bottom sole, a plurality of attachment rings or hooks disposed on the front bottom sole, a training boot system of two training boots as described herein, with a resistance band or cord attaching the two boots.

U.S. Pat. No. 8,622,879 to Ihli, et al discloses Exercise Shoe Methods And Apparatus: which include a shoe body, at least one support bracket integrated into the shoe body, and a resistance device connected to the support bracket. The resistance device preferably includes a flexible member, and may include a housing from which the flexible member is extracted. Ihli, et al fails to disclose a sole extending in the location of the ball of a foot with a greater thickness than any sole extending in the location of the heel of the foot, a boot upper of a mesh material, a receptacle fastening member disposed on the boot upper that is configured and arranged for attaching a resistance band, a weight housing disposed on the boot upper, a sensor housing disposed on the boot upper, a sensor housing that is configured and arranged to receive interchangeable sensors, a sensor housing disposed in the front bottom sole, an interchangeable tread on the bottom of the sole, a training boot system of two training boots as described herein, with a resistance band or cord attaching the two boots.

BRIEF SUMMARY OF THE INVENTION

In a first set of examples, an training boot apparatus is disclosed, the apparatus including: a front bottom sole, a boot upper disposed on the sole, a weight housing disposed on the boot upper, wherein the sole extends in the location of the ball of a foot with greater thickness than any sole extending in the location of the heel of the foot.

In a one example, the boot upper is a strap.

In further example, the boot includes a heel strap in connection with the front bottom sole.

In one example, the boot upper includes a mesh material.

In further example, the receptacle fastening member is disposed on the boot, configured and arranged for attaching a resistance band.

In further example, a receptacle fastening member is disposed on the upper.

In one example, the training boot includes a sensor housing disposed on the boot upper. In further example, the training boot includes a sensor disposed in the sensor housing. In one example, the sensor housing is configured and arranged to receive interchangeable sensors.

In one example, the training boot includes a sensor housing disposed in the front bottom sole. In further example, the training boot includes a sensor disposed in the sensor housing. In one example, the sensor housing is configured and arranged to receive interchangeable sensors.

In further example, the training boot includes a weight disposed in the weight housing.

In further example, the weight housing is configured and arranged to receive interchangeable weights.

In further example, the training boot includes a plurality of attachment rings or hooks disposed on the front bottom sole.

In further example, the training boot includes a tread on the bottom of the sole. In further example, the tread is interchangeable.

In further example, the front bottom sole is between one and two inches greater in thickness in the location of the ball of a foot, relative to the thickness of any sole extending in the location of the heel of the foot.

In another set of examples, an training boot system is disclosed, the system including: two training boots as herein described, one configured for the left foot and the other configured for the right foot; and a resistance band or cord having one end removably attached to the one boot and the other end removably attached to the other boot.

DETAILED DESCRIPTION

Figure 1:
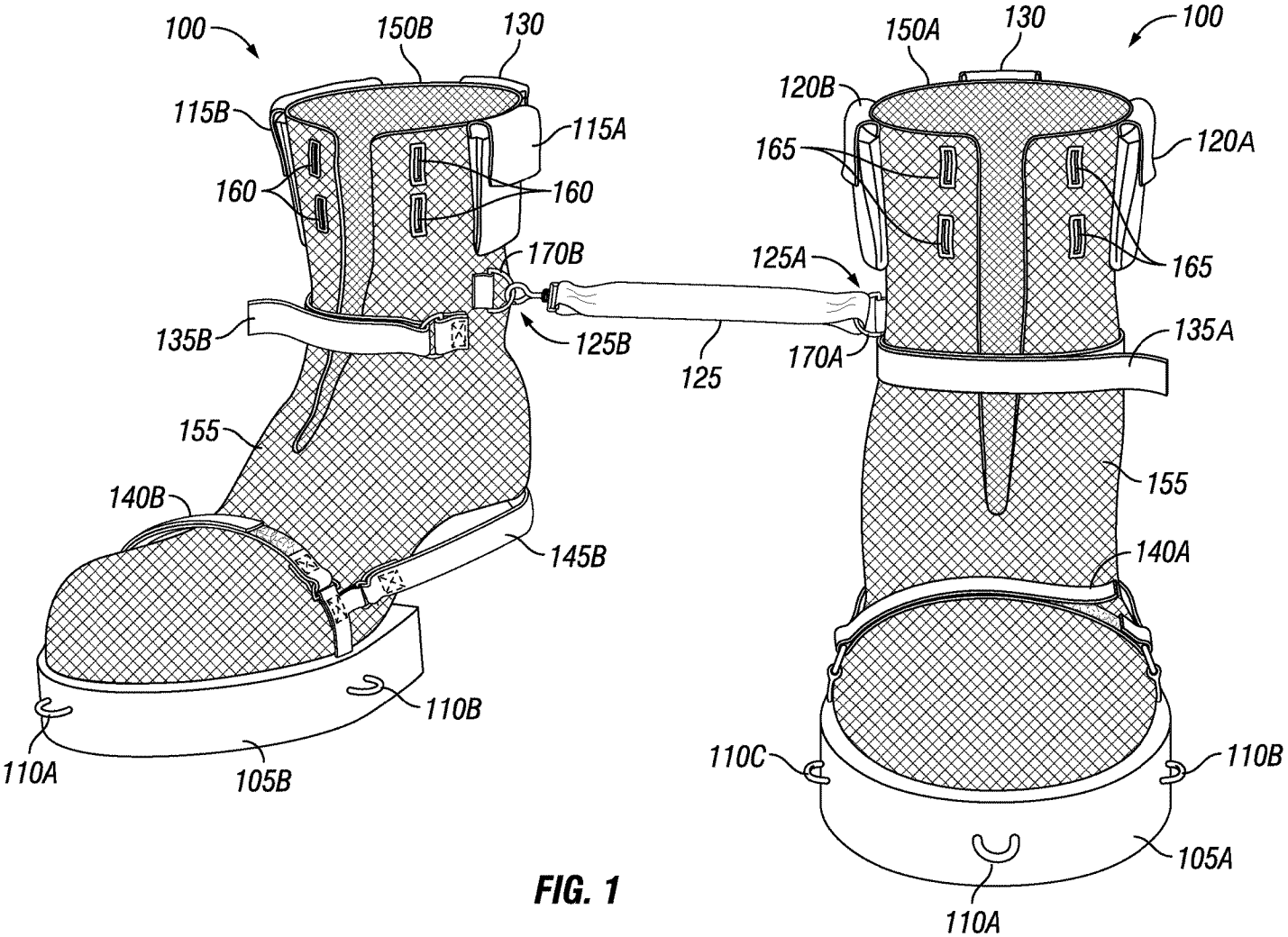
FIG. 1 illustrates a 3-D perspective view of an example using two boots with resistance band attaching the two boots.

FIG. 1 illustrates a 3-D perspective view of an example using two boots with resistance band attaching the two boots. In one example, the boot as illustrated brings together a combination of tools that work synergistically for exercise and/or therapeutic purposes. The level and extent of synergistic advantage was not previously appreciated, as it was thought that the tools would interfere with the performance of each other, rather than augment and enhance the effectiveness in training and/or therapy over practicing the tools individually and independently.

In one example, a boot pair system 100 is shown with a left 150A and a right boot 150B and with a resistance band 125 connecting the two boots.

As shown in this example, the upper 155 of the boot encloses a portion of the foot, namely the front (toe) portion of a foot that includes, in one example, the toe mounds, above the heel, the ankle, and a portion above the ankle bone. In one example, the upper 155 is shaped to fit the heel, ankle, and toe/toe-mound portions of the foot and leg. In one example, as illustrated, the heel portion of the foot is not enclosed.

In one example, as illustrated, upper 155 houses the foot using a mesh material, providing flexibility, strength, and ventilation to the foot as the foot undergoes exercise or therapy or rehabilitation.

In one example, the covering or mesh of upper 155 is not used and upper 155 is reduced to a strap.

In one example, one tool is the structure, positioning and arrangement of the bottom sole. A bottom sole 105A, 105B is affixed to the bottom of upper 155, in at least the toe portion of upper 155. As illustrated, bottom sole 105A is shown on the left boot and bottom sole 105B is shown on the right boot. In one example, bottom sole 105 is two inches thick around the location of the ball portion of the foot. In one example, the bottom sole total height (including any attachable treads/soles) is between two inches and three inches, to stay within a risk-free zone for injuries. In one example, bottom sole 105 is not more than two inches thick. In one example, bottom sole 105 is three inches thick, including the thickness of any attachable treads/soles. In the example as illustrated, bottom sole 105 is located beneath the area for the toes and toe mounds and terminates at the most forward portion of the inner arch of the foot. The toe mounds are also call the ball of the foot. In this example, there is no sole beneath most of the inner arch, outer arch, front of heel, and heel. Thus, the bottom sole 105 resides beneath and supporting, elevating the front "two tires" (the outer little toe mound and the inner big toe mound) but does not provide support or elevation to the rear "two tires" (the outer heel and the inner heel).

In one example, the operative structure for the bottom sole is that support and elevation are provided to the front "two tires" (the outer little toe mound and the inner big toe mound) to a greater extent than support or elevation provided to the rear "two tires" (the outer heel and the inner heel). In one example, not illustrated, the bottom sole extends from toe to heel, but the front portion of the bottom sole (that portion providing support and elevation to the toe mounds) is thicker than the rear portion of the bottom sole (that portion providing support to the outer arch and/or heel).

Thus, the bottom sole, as it is described in providing enhanced elevation or height to the front of the foot, relative to the heel of the foot, is called a "front bottom sole."

In one example, the bottom sole has an interchangeable tread.

In one example, one tool is the structure, positioning and arrangement of a resistance band, attached to one or both boots. A band or cord 125 is attached at an attachment point on boot 150. In one example, band or cord 125 is an interchangeable band, the various bands having different selected resistive strengths. The user, while wearing the boot, stretches the band with their leg(s). The user encounters resistance as they pull on the band. The band provides the opportunity to gain more flexibility and athleticism through exercise, training or rehabilitative methods that use stretching as part of the routine. In one example, one end 125A of band 125 is attached to a left boot 150A via a fastener 170A on the left boot. The other end 125B of band 125 is attached to a right boot 150B by way of a fastener 170B on the right boot. In one example, fasteners 170A and 170B are disposed on respective upper 155, above the location of the ankle bone. In one preferred example, fasteners 170A, 170B include "D" rings that receive a locking hook structure off the ends 125A, 125B of band 125. The "D" ring fastener combination provides a combination of economics, reliability, and consumer acceptance.

Thus, the fastener, as described in being disposed on the boot and receiving a cooperating fastening structure from the band, is called a "receptacle fastening member."

In one example, band 125 is a resistance band, meaning that the band stretches with resistance when pulled. In one example, band 125 is a stretchable, tubular cord. In one preferred example, band 125 is a tubular rubber cord. The inventor believes professional research shows that using a tubular rubber cord is a very effective way to build the body with strength, ligaments flexibility, and tendons. Activity that causes the muscles to contract against resistance will elicit a training response. A resistance band or tube serves as a resistance to improve lateral quickness and strength. The resistance band or tube serves as a means to rehabilitate and build strength.

In one example, one tool is the structure, positioning and arrangement of ankle weight housings attached to the upper portion of the boots 150, above the location of the ankle bone. In one example, as illustrated, ankle weight housing 115A is attached to left inside portion of upper 155 of right boot 150B. As illustrated, ankle weight housing 115A is an upwardly opening pocket with cover. Ankle weight housing 115A is shown attached at the very top of upper 155, above the location of the ankle bone and above the location of fastener 170 for the resistance band 125. In other examples, the ankle weight housing is attached at other locations on upper 155 or boot 150.

Figure 3:
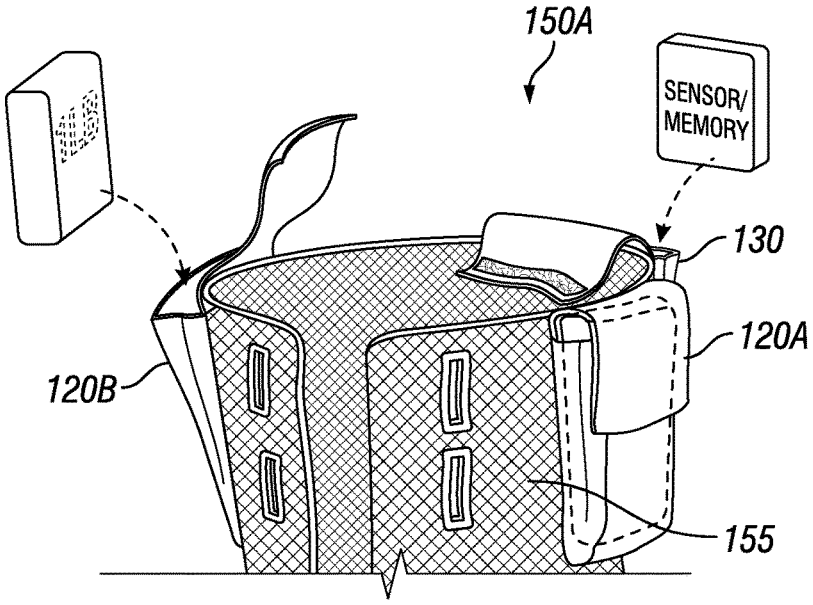
FIG. 3 illustrates a 3-D perspective detail view of the upper portion of an example of a boot, showing the sensor/memory and weight housings.

A weight, as will be shown in FIG. 3, is selected and deposited into the pocket of the ankle weight housing. As weights can vary in weight, the amount of weight can be pre-selected by depositing the desired weight selection into one or more of the ankle weight housings. In one example, weights are solid. In one example, weights are bags of sand or high-density particles (iron, lead, barite, uranium, etc). In one example, weights are rectangular, semi-curved sheets that stack together to vary the total weight. In the example as illustrated, another ankle weight housing 115B is attached to right outside portion of upper 155 of right boot 150B. In a symmetrical fashion, an ankle weight housing 120A is attached to left outside portion of upper 155 of left boot 150A and an ankle weight housing 120B is attached to right inside portion of upper 155 of left boot 150A.

In one example, one tool is the structure, positioning and arrangement of sensor housings attached to the upper portion of the boots 150, above the location of the ankle bone. In one example, as illustrated, sensor housing 130 is shown attached at the very top of upper 155, at the back or heel portion of upper 155, above the location of the ankle bone and above the location of fastener 170 for the resistance band 125. In other examples, the sensor housing is attached at other locations on upper 155 or boot 150. In the example as illustrated, sensor housing 130 is an upwardly opening pocket with cover. In example as illustrated, sensor housing 130 is similar or identical in structure and appearance to weight housings 115, 120. In one example, the structure, positioning, and arrangement of sensor housing 130 is adapted to receive the same shaped weights as the weight housings 115, 120.

In one example, one tool is a sensor, as will be shown in FIG. 3, that is selected and deposited into the pocket of the sensor housing. As sensors can vary in functionality, a sensor with a pre-selected functionality or set of functionalities or selectable functionality(ies) is pre-selected by depositing the desired sensor into one or more of the sensor housings. In one example, the sensor is configured to enable deposit into one or more of the weight housings. In one example, the sensor housing is in electrical or wireless communication with the bottom sole 105 for the purpose of receiving sensing data from the bottom sole and delivery to the sensor. In one example, the sensor housing is in electrical communication with the bottom sole 105 for the purpose of receiving energy, such as from a battery deposited in the sole.

A collection of one or more fastening devices is attached to the boot 150 for securing the boot to the foot of the wearer during exercise or therapy. In one example, top foot straps 140A and 140B secure the sole 105 and toe/toe-mound portion of upper 155 by providing an adjustable strap across the toe-mound/front inner arch portion of the foot. Foot strap 140A is attached to left boot 150A and foot strap 140B is attached to right boot 150B, for example. In the example, as illustrated, foot straps 140A and 140B are attached respectively to sole 105A and 105B, relieving tensile stress on walking from upper 155 to delay wear and separation of upper 155 from sole 105. In one example, as illustrated, boot 150 is additionally secured to the foot by way of heal or back strap 145. The ends of heal strap 145, in the example as illustrated, is secured to foot strap 140 and loops around the back so as to wrap around the Achilles, between the heel and the ankle bone. In the absence of a sole in the heel portion of the foot, this strap provides additional attachment to prevent the boot from slipping during exercise or therapy. In one example, the heel strap is in connection with the front bottom sole, for example, the ends of the heel strap are fastened to the top foot strap, which, in turn, is secured to the sole 105. In one example, as illustrated, the upper opening of upper 155 is expandable to allow clearance for insertion of the foot and ankle bone. Once the foot is inserted, ankle strap 135A (on boot 150A), 135B (on boot 150B) is used to tighten upper 155 around the foot, proximate to the location of the ankle bone. In the example, as illustrated, ankle strap 135A, 135B is disposed and secured across an expansion groove of upper 155 in the location of the top of the foot, above the inner and outer arch and in the proximity of the top of the foot across the ankle bone. In one example, as illustrated, shoe string holes 160 (right boot 150B) and 165 (left boot 150A) with reinforcement stitching are disposed on either side of the expansion groove of upper 155 which is located across the location of the top of the foot and above the location of the ankle bone, at the beginning of the leg of the foot at near the top upper 155, where upper 155 is upwardly open for receiving a foot. In preferred examples: top foot straps 140 use velcro-style hook-and-loop material for fastening, heel/back straps 145 use Velcro-style hook-and-loop material for fastening, ankle straps 135 use Velcro-style hook-and-loop material for fastening.

Returning to the use of resistance bands as an exercise or therapeutic tool, in one example, an additional tool are attachment hooks secured to the outside side walls of the sole 105. In the example, as illustrated, attachment hooks 110A are secured to the frontmost portion of the toe of sole 105. Attachment hooks 110B are secured to the left side of each sole 105 (for the left boot 150A, this would be the left or outer side of the boot; for the right boot 150B, this would be the left or inner side of the boot). Attachment hooks 110C are secured to the right side of each sole 105 (for the left boot 150A, this would be the right or inner side of the boot; for the right boot 150B, this would be the right or outer side of the boot, not shown in FIG. 1). In one example, attachment hooks or rings 110 allow a user to work on a single foot or leg to rehabilitate. In one example, resistance band 125 is attached by one end to one of attachment hooks 110 and attached by the other end to some fixture, such as a wall. This enables a variety of exercise or therapy protocols to be developed which are based on the selection of resistance band and the attachment point to the boot 150. In one example, only one boot is used. The resistance band is attached to the one boot and also to some other fixture.

By placing and integrating a selection and combination of these tools into one boot, it is possible to dispense with multiple types of exercise/therapy boots. It also enables more advanced exercise and therapy protocols to be performed, as the protocols enable quick switching from exercise/therapy motions involving the special sole to those using the resistance band, to those using both. Further, weights can be quickly added, removed, or changed. In examples with a sensor also enabled, the activity of the user can be monitored and evaluated by a person or by a computer program. In examples, the computer program can immediately recognize need for adjusting the exercise/therapy protocol and report back to the user, trainer/coach, or doctor/therapist—enabling the user to modify their exercise motions adaptively. A further breakthrough, in examples, the sensor data can be recorded over exercise/therapy sessions to track progress in athletic performance or physical therapy and recovery. In an example breakthrough, objective measurements are taken in a diagnostic fashion, based on performance using the special sole or resistance band or weights, or combinations of sole, band, weights. These objective measurements can be used to classify extent of disablement, progress in regaining physical ability, and be used as predictors of potential for and extent of recovery. In a similar fashion, these objective measurements can be used for measurement, classification, and prediction of physical prowess in an exercise or athletic setting. Objective measurements can be a useful tool for the training coach or athletic franchise.

In summary, in one example, the training boot includes a front bottom sole, a boot upper disposed on the sole, a weight housing disposed on the boot upper, where the sole extends in the location of the ball of the foot with substantially greater thickness (two inches or more) than any sole extending in the location of the heel of the foot. In one example, the boot upper is a strap. In one example, the boot upper is composed of a mesh material. In one example, the boot includes a receptacle fastening member disposed on the boot for attaching a resistance band. In one example, the receptacle fastening member is disposed on the upper. In one example, a weight is disposed in the weight housing. In one example, the weight housing is configured and arranged to receive interchangeable weights. In one example, the boot includes a tread on the bottom of the sole. In one example, the tread is interchangeable. In one example, a boot system includes two training boots as described, a resistance band having one end of the band attached to one boot and the other end attached to the other boot. In one example, a front sole is defined as a sole where the toe or ball of the foot portion of the sole is thicker than the rear/heel portion of the sole, if any. In one example, the front sole is also called a half-platform shoe.

Figure 2A:
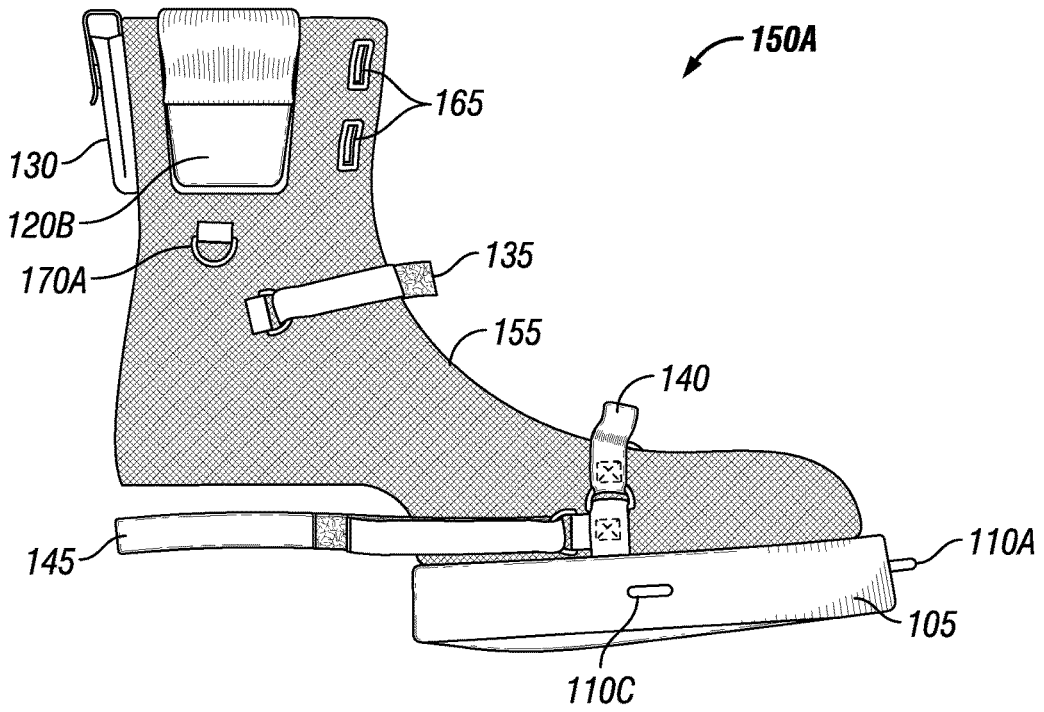
FIG. 2A illustrates a right side view of an example of a left boot.
Figure 2B:
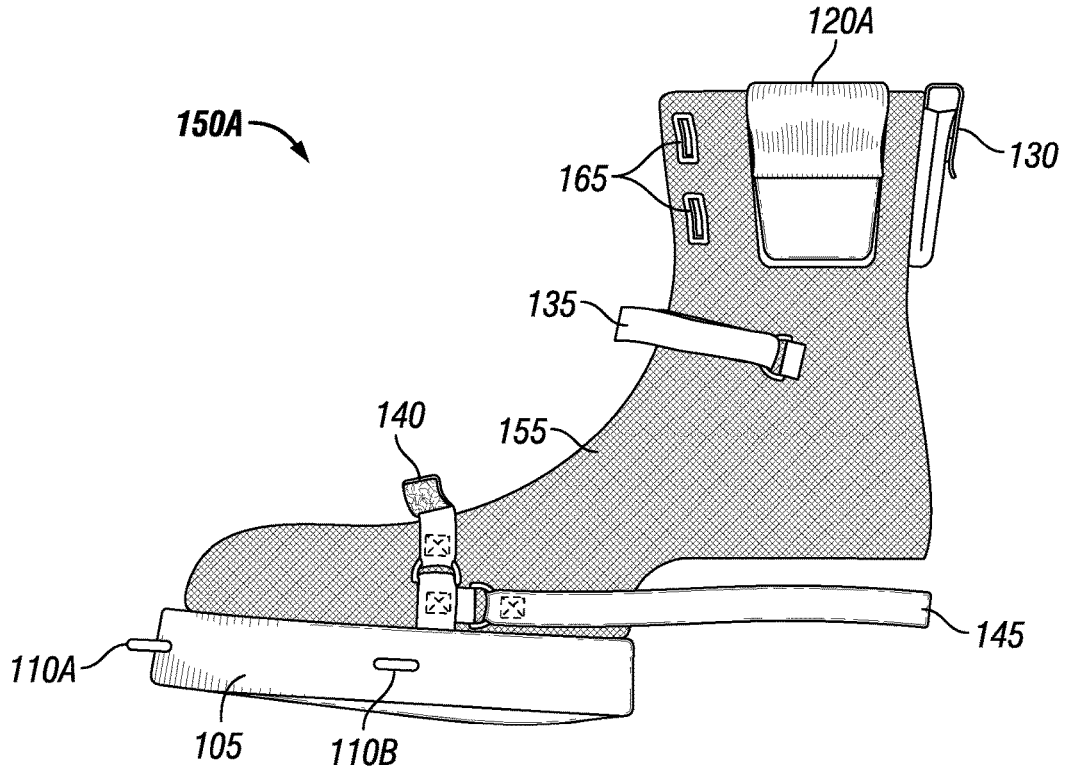
FIG. 2B illustrates a left side view of an example of a left boot.

FIG. 2A illustrates a right side (inner) view of an example of a left boot 150A. As shown in this example, the upper 155 of the boot encloses a portion of the foot, namely the front (toe) portion of a foot that includes, in one example, the toe mounds, above the heel, the ankle, and a portion above the ankle bone. In one example, the upper 155 is shaped to fit the heel, ankle, and toe/toe-mound portions of the foot and leg. In one example, as illustrated, the heel portion of the foot is not enclosed. Sole 105 is attached to upper 155 in the area for the toes and toe mounds (the ball of the foot) and terminates at the most forward portion of the inner arch of the foot. In this example, there is no sole beneath most of the inner arch, outer arch, front of heel, and heel. Thus, the bottom sole 105 resides beneath and supporting, elevating the front "two tires" (the outer little toe mound and the inner big toe mound) but does not provide support or elevation to the rear "two tires" (the outer heel and the inner heel). The sole serves to force the front of the foot to rest higher than the heel of the foot, which is sometimes called a "jump" sole. In this example, the upper 155 does not enclose the heel. Rather, strap 145 is attached to strap 140 and is configured to loop around the heel of the foot of the user. As top foot strap 140 is secured to sole 105, and heel strip 145 secured to top strap 140, the straps are not placing significant tension stress on upper 155. In one example, this helps to enable upper 155 to be made of one of a variety of materials, including a mesh that allow ventilation for the user's foot. In one example, upper 155 is styled with more or less covering material, to suit the design tastes of various consumers. Also illustrated is ankle strap 135, in one example using velcro-style hook-and-loop material for fastening, which is secured across an expansion groove of upper 155 in the location of the top of the foot, above the inner and outer arch and in the proximity of the top of the foot across the ankle bone. In one example, the tongue of ankle strap 135 traverses from the left side to the right side of boot 150A (as shown in FIGS. 2A and 2B). In one example, the tongue of ankle strap 135A traverses from the right side to the left side of boot 150A (as shown in FIG. 1). In another example, Fastener 170A is disposed slightly above and to the heel-ward rear of strap 135. In one example, fastener 170A is disposed on upper 155, above the location of the ankle bone. In one preferred example, fastener 170A includes a "D" ring that receives a locking hook structure off the ends of band 125. The "D" ring fastener combination provides a recognizable hooking opportunity for the consumer to attach a selected resistance device. Attachment hooks 110A and 110C secured to sole 105 are visible in this illustrated example. Attachment hooks 110 serve as anchor attachment points for a resistance band. In one example, as illustrated, shoe string holes 165 with reinforcement stitching are disposed on either side of the expansion groove of upper 155 which is located across the location of the top of the foot and above the location of the ankle bone, at the beginning of the leg of the foot at near the top upper 155, where upper 155 is upwardly open for receiving a foot. Ankle weight housing 120B is attached to right inside portion of upper 155 of left boot 150A. In this example, as illustrated, housing 120B upwardly opens as a pocket and has a lip covering. In this example, the top of housing 120B coincides with the top of upper 155 at the opening for insertion of a foot. In one example, as illustrated, sensor housing 130 is shown attached at the very top of upper 155, at the back or heel portion of upper 155, above the location of the ankle bone and above the location of fastener 170 for the resistance band 125. In this example, the top of sensor housing 130 coincides with the top of upper 155 at the opening for insertion of a foot. In this example, as illustrated, sensor housing 130 upwardly opens as a pocket and has a lip covering. In one example, not illustrated, communication and/or power wires run through upper 155 from sensor housing 130 to sole 105.

FIG. 2B illustrates a left side (outer) view of an example of a left boot 150A. As shown in this example, the upper 155 of the boot encloses a portion of the foot, namely the front (toe) portion of a foot that includes, in one example, the toe mounds, above the heel, the ankle, and a portion above the ankle bone. In one example, the upper 155 is shaped to fit the heel, ankle, and toe/toe-mound portions of the foot and leg. In one example, as illustrated, the heel portion of the foot is not enclosed. Sole 105 is attached to upper 155 in the area for the toes and toe mounds (the ball of the foot) and terminates at the most forward portion of the inner arch of the foot. In this example, there is no sole beneath most of the inner arch, outer arch, front of heel, and heel. Thus, the bottom sole 105 resides beneath and supporting, elevating the front "two tires" (the outer little toe mound and the inner big toe mound) but does not provide support or elevation to the rear "two tires" (the outer heel and the inner heel). The sole serves to force the front of the foot to rest higher than the heel of the foot, which is sometimes called a "jump" sole. In this example, the upper 155 does not enclose the heel. Rather, strap 145 is attached to strap 140 and is configured to loop around the heel of the foot of the user. As top foot strap 140 is secured to sole 105, and heel strip 145 secured to top strap 140, the straps are not placing significant tension stress on upper 155. In one example, this helps to enable upper 155 to be made of one of a variety of materials, including a mesh that allow ventilation for the user's foot. In one example, upper 155 is styled with more or less covering material, to suit the design tastes of various consumers. Also illustrated is ankle strap 135, in one example using velcro-style hook-and-loop material for fastening, which is secured across an expansion groove of upper 155 in the location of the top of the foot, above the inner and outer arch and in the proximity of the top of the foot across the ankle bone. Attachment hooks 110A and 110B secured to sole 105 are visible in this illustrated example. Attachment hooks 110 serve as anchor attachment points for a resistance band. In one example, as illustrated, shoe string holes 165 with reinforcement stitching are disposed on either side of the expansion groove of upper 155 which is located across the location of the top of the foot and above the location of the ankle bone, at the beginning of the leg of the foot at near the top upper 155, where upper 155 is upwardly open for receiving a foot. Ankle weight housing 120A is attached to right inside portion of upper 155 of left boot 150A. In this example, as illustrated, housing 120A upwardly opens as a pocket and has a lip covering. In this example, the top of housing 120A coincides with the top of upper 155 at the opening for insertion of a foot. In one example, as illustrated, sensor housing 130 is shown attached at the very top of upper 155, at the back or heel portion of upper 155, above the location of the ankle bone. In this example, the top of sensor housing 130 coincides with the top of upper 155 at the opening for insertion of a foot. In this example, as illustrated, sensor housing 130 upwardly opens as a pocket and has a lip covering. In one example, not illustrated, communication and/or power wires run through upper 155 from sensor housing 130 to sole 105.

FIG. 3 illustrates a 3-D perspective detail view of the upper portion of an example of a boot 150A, showing the sensor/memory and weight housings. In one example, as illustrated, sensor housing 130 is shown attached at the very top of upper 155, at the back or heel portion of upper 155. In this example, the top of sensor housing 130 coincides with the top of upper 155 at the opening for insertion of a foot. In this example, as illustrated, sensor housing 130 upwardly opens as a pocket and has a lip covering. In this example, as illustrated, the lip covering is peeled back to expose the pocket of sensor housing 130. A sensor/memory sized to fit inside sensor housing 130 is shown floating above with arrow, indicating placement into the pocket of sensor housing 130.

In the present examples, one of a number of types of collection sensors are selectable and disposable into sensor housing 130, offering a wide range of diagnostic and therapeutic or rehabilitation options. In one example, the collection sensor is an integrated sensor with memory and processing unit. In one example, the integrated sensor includes a power source, for example, a battery. In one example, the collection sensor is an integrated sensor with memory, processing unit, and RF communications. In one specific example, the integrated sensor includes the pre-selected sensor, battery, and ESP8622 combined microcontroller and wi-fi ("full TCP/IP stack") manufactured by Espressif, or equivalent. In one example, the sensor is structured and configured to collect sensed motion data, for example, acceleration. In one example, the sensor is an accelerometer. In one example, the sensor is structured and configured to collect sensed changes in orientation, for example gyroscope data. In one example, the sensor includes a gyroscope. In one example, the sensor is a pressure sensor. In one example, a combination of sensors are used, for example both sensed motion and sensed changes in orientation are collected, for example both gyroscope and accelerometer sensors are employed.

In one example, a sensor is deposited or otherwise inserted in sole 105 and sends its sensed information to a device that is held in sensor housing 130. In one example, the memory, processing unit, and RF communications are contained in sensor housing 130.

In one example, as illustrated in FIG. 3, weight housing 120A and 120B are shown attached at the very top of upper 155, on each outer side of upper 155. In this example, the top of weight housing 120A and 120B coincides with the top of upper 155 at the opening for insertion of a foot. In this example, as illustrated, weight housing 120A and 120B each upwardly opens as a pocket and each has a lip covering. In this example, as illustrated, the lip covering is peeled back to expose the pocket of weight housing 120B. A weight sized to fit inside weight housing 120B is shown floating above with arrow, indicating placement into the pocket of weight housing 120B. In one example, weights are one pound. In one example, the total capacity of the weight housings for each boot is one and one-half pounds, to stay within a risk-free zone for injury.

Figure 4A:
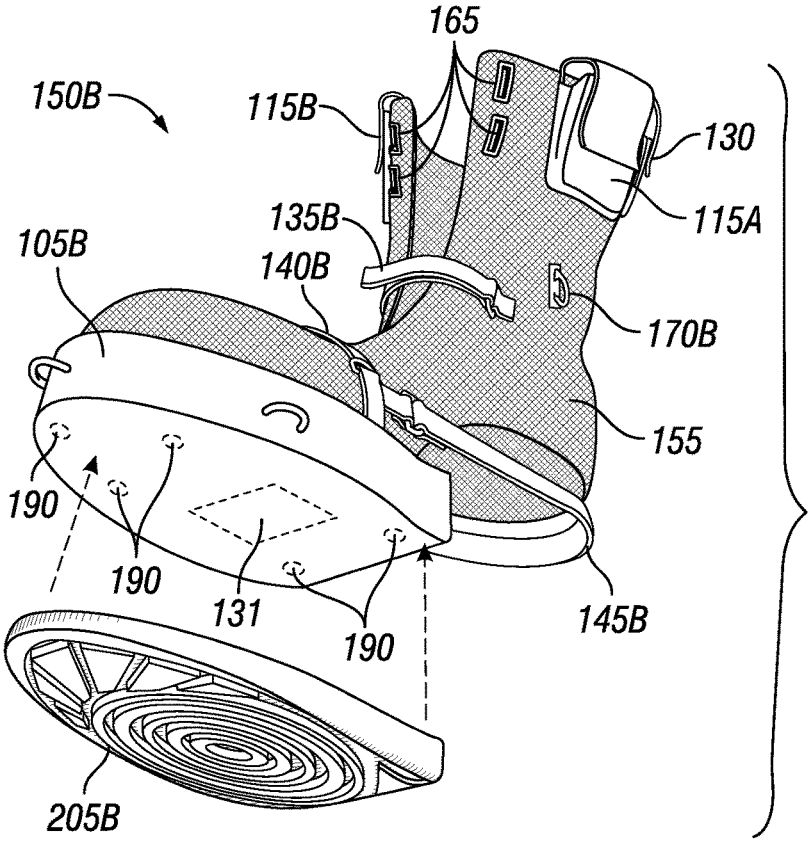
FIG. 4A illustrates a 3-D perspective partially exploded detail left side view of an example of a right boot with attachable/detachable indoor sole 205 (the sole unattached, with arrows showing direction towards attachment).

FIG. 4A illustrates a 3-D perspective partially exploded detail left side view of an example of a right boot 150B with attachable/detachable indoor sole 205B (the sole unattached, with arrows showing direction towards attachment). In the example, as illustrated, fastening points 190 indicate screw-in points for attachment of sole 205B to sole 105B. The bottom, outer pattern of sole 205B is configured and arranged for indoor sole performance.

In one example, one tool is the sole design, structure, positioning and arrangement of attachable sole. For certain performance measurements, whether observed by the trainer or therapist or collected by way of sensors, the sole will impact the performance measurements. For example, a selectable combination of attachable sole, resistance band, weight(s), and sensor(s) is used for a particular treatment or exercise protocol. In one example, the height of the attachable sole is pre-determined for a particular exercise or therapeutic purpose.

In one example, a housing or recess 131 is contained in sole 105B for the purpose of housing a sensor. In one example, a sensor is deposited or inserted in sole 105B. In one example, a sensor is placed in housing or receptacle 131 instead of placing the sensor in sensor housing 130. In one example, a sensor is placed in housing or receptacle 131 and sends its sensed information to a device that is held in sensor housing 130. As can be appreciated, in examples, a housing or recess 131 is alternatively or also contained in the sole 105A of the other boot. In one example, housing 131 is in one boot, or the other boot, or both boots.

Figure 4B:
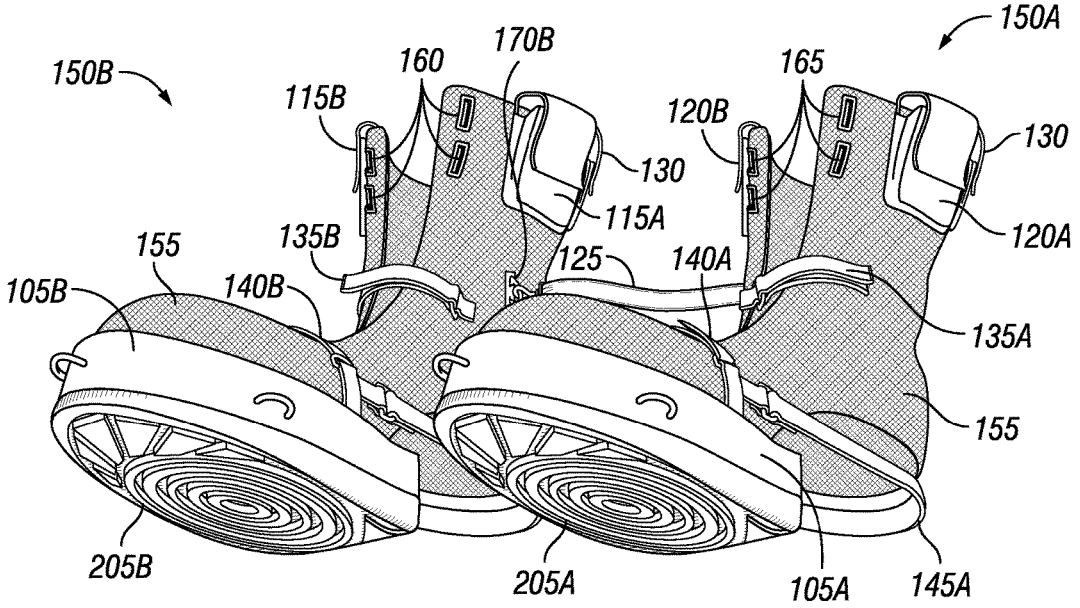
FIG. 4B illustrates a 3-D perspective detail left side view of an example of the two boots in the system configuration with attachable/detachable indoor sole 205 (the sole attached).

FIG. 4B illustrates a 3-D perspective detail left side view of an example of left boot 150A and right boot 150B with respective attachable/detachable indoor soles 205A and 205B (the soles attached). In one example, the thickness of soles 105A and 105B are up to two inches thick, with attachable/detachable soles adding an additional up to one inch thickness, providing a total of up to three inches thickness. In one example, as illustrated, the soles terminate within the location of the arch area of the foot such that no sole exists in the location of the heel portion of the foot. In one example, the sole is extended into the back of the foot, the heel portion, for some minimal protection of the foot. In such an example, the thickness of the sole in the heel portion is significantly reduced compared to the front, ball portion of the sole, providing at least a one to three inch relative height difference of the sole between the ball portion and the heel portion. A preferred example is to refrain from providing a sole in the heel portion, or to have a heel sole separate from the ball sole, to provide maximum freedom of flexing of the arch region between the heel and the front of the foot.

In this example, as illustrated, attachable/detachable indoor sole 205 is attached to the bottom of sole 105. Fasteners on the top, inner side of sole 205 correspond to paired fasteners 190 on the bottom side of sole 105. In one example, wedged snapping clips on sole 205 are insertable into corresponding paired holes on the bottom of the sole 105. In one example, screw holes on sole 205 correspond to paired threaded screw holes on sole 105. Screws with corresponding size and threading are then inserted through the holes of sole 205 and into the threaded holes of sole 105. In one example, the screws are made of a nylon material, or equivalent. In one example, the screws include a screw head with a groove for turning the head of the screw. In one example, the groove is sized to accept the edge of a U.S. dime. In one example, the tongue of top foot strap 140A traverses from the left side to the right side of boot 150A (as shown in FIG. 4B). In one example, the tongue of top foot strap 140A traverses from the right side to the left side of boot 150A (as shown in FIG. 1).

Figure 5A:
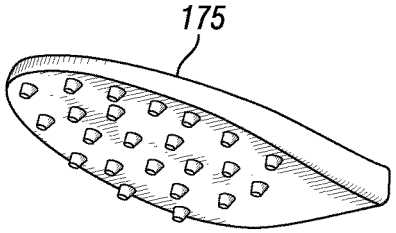
FIG. 5A illustrates a 3-D perspective view of an attachable/detachable turf sole (as shown, detached from boot).

FIG. 5A illustrates a 3-D perspective view of an attachable/detachable turf sole 175 (as shown, detached from boot). In the example, as illustrated, approximately two dozen (more or less) cleats or spikes are integrated into the bottom of the sole 175. In one example, the spikes are small rubber spikes.

Figure 5B:
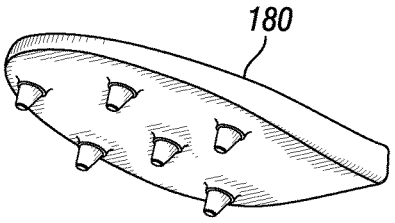
FIG. 5B illustrates a 3-D perspective view of an attachable/detachable cleat sole (as shown, detached from boot).

FIG. 5B illustrates a 3-D perspective view of an attachable/detachable cleat sole 180 (as shown, detached from boot). In the example, as illustrated, approximately a dozen (more or less) cleats are integrated into the bottom of the sole 175. In one example, the spikes are coarse round rubber cleats.

Figure 5C:
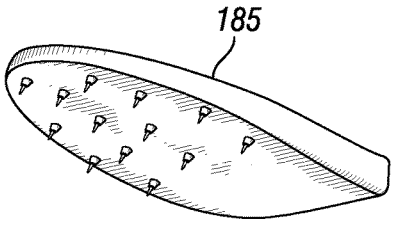
FIG. 5C illustrates a 3-D perspective view of an attachable/detachable spike sole (as shown, detached from boot).

FIG. 5C illustrates a 3-D perspective view of an attachable/detachable spike sole 185 (as shown, detached from boot). In the example, as illustrated, small iron spikes are attached into the bottom of the sole 175.

Consumer economics is important in exercise and therapeutic wear. The attachable/detachable soles saves the user money, space, and trouble in keeping different pairs of boots for different uses. Further, as needs change, or new developments in optimum sole patterns emerge, the attachable/detachable allows for customization and/or future sole option selection and purchase, without having to endure the expense of purchasing a whole new set of boots.

Figure 6:
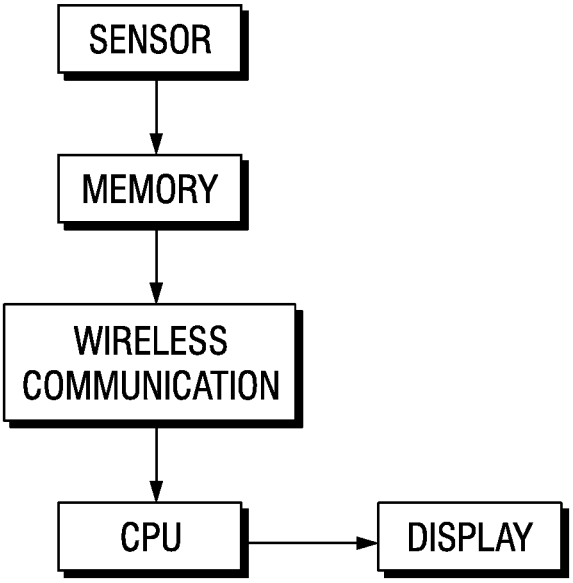
FIG. 6 illustrates a schematic diagram of one example of a sensor to CPU connection via wireless communication.

FIG. 6 illustrates a schematic diagram of one example of a sensor to CPU connection via wireless communication. In this example, as schematically illustrated, a sensor communicates with a memory collection unit. In one example, the sensor is located inside sole 105. In one example, memory collection unit is located in sensor housing 130. In one example, memory collection unit wirelessly transmits to a CPU which is separate from boot 150. CPU provides a display for use by the user, their trainer or therapist or doctor.

In summary, the components or tools work in operative and cooperative combination to achieve the synergistic effects of combinations of exercise or therapy routines. New exercise or therapy routines and protocols can now be developed that until now were not possible. By using a boot with combined half-platform sole, resistance bands, and ankle weights at the same time during training, it is possible for athletes to respond to training much faster, growing much stronger leg muscles and boosting their quickness and agility.

The athletic training boot as described herein is the latest innovation in helping athletes, fitness men and women, and debilitative individuals build strength, quickness, balance, speed, and athleticism (jumping). This unique concept brings together a combination of tools to gain the needed edge in training to be the best athlete a person can be, or even build and rebuild strength. In one example, five main areas of focus are the sole of the boot, the changeable tread, the tubular cord, the ankle weight, and the sensor/data collection. These components working together give each individual a resistance training method with training or therapy recipes that until now were impossible to conceive or implement.

These and other objectives, features, and advantages of the present invention will become apparent from the following detailed drawings and associated description that accompanying the drawings.

Although the present invention is described herein with reference to a specific preferred embodiment(s), many modifications and variations therein will readily occur to those with ordinary skill in the art. Accordingly, all such variations and modifications are included within the intended scope of the present invention as defined by the reference numerals used.

From the description contained herein, the features of any of the examples, especially as set forth in the claims, can be combined with each other in any meaningful manner to form further examples and/or embodiments.

The foregoing description is presented for purposes of illustration and description, and is not intended to limit the invention to the forms disclosed herein. Consequently, variations and modifications commensurate with the above teachings and the teaching of the relevant art are within the spirit of the invention. Such variations will readily suggest themselves to those skilled in the relevant structural or mechanical art. Further, the embodiments described are also intended to enable others skilled in the art to utilize the invention and such or other embodiments and with various modifications required by the particular applications or uses of the invention.

The invention claimed is:

1. A training boot system comprising:

a right and a left training boot, each training boot comprising:

a front bottom sole, a plurality of attachment rings or hooks disposed on the front bottom sole, a tread on the bottom of the front bottom sole, a boot upper disposed on the front bottom sole, a weight housing disposed on the boot upper, a sensor housing disposed on the boot upper, a receptacle fastening member disposed on the training boot, configured and arranged for attaching a resistance band, and wherein a thickness of the front bottom sole is configured to raise the boot upper from a ground or floor surface, whereby a space is defined between the ground or floor surface and a bottom edge of the boot upper, proximate to a heel of the boot upper, wherein the boot upper is configured and arranged to enclose that portion of a foot including the foot toe mounds, ankle, and a portion above the ankle bone, and wherein a bottom edge of the boot upper proximate to the ankle is raised relative to the bottom edge of the boot upper disposed on the front bottom sole.

2. The training boot system of claim 1 further comprising a resistance band having two ends, each end configured and arranged to connect to the respective left ankle boot receptacle fastening member and the right training boot receptacle fastening member.

3. The training boot system of claim 1 further comprising a sensor disposed in the sensor housing.

4. The training boot system of claim 1 wherein the sensor housing is configured and arranged to receive interchangeable sensors.

5. The training boot system of claim 1 comprising a weight disposed in the weight housing.

6. The training boot system of claim 1 wherein the weight housing is configured and arranged to receive interchangeable weights.

7. The training boot system of claim 1 wherein the tread is interchangeable.

8. The training boot system of claim 1 wherein the front bottom sole is between one and two inches greater in thickness in the location of a ball of a foot, relative to the thickness of any portion of the front bottom sole extending in the location of a heel of the foot.

9. A training boot comprising:

a front bottom sole, a boot upper disposed on the front bottom sole, a weight housing disposed on the boot upper, wherein a thickness of the front bottom sole is configured to raise the boot upper from a ground or floor surface, whereby a space is defined between the ground or floor surface and a bottom edge of the boot upper, proximate to a heel of the boot upper, wherein the boot upper is configured and arranged to enclose that portion of a foot including the foot toe mounds, ankle, and a portion above the ankle bone, and wherein a bottom edge of the boot upper proximate to the ankle is raised relative to the bottom edge of the boot upper disposed on the front bottom sole.

10. The training boot of claim 9 further comprising a heel strap in connection with the front bottom sole.

11. The training boot of claim 9 wherein the boot upper is comprised entirely of a mesh material.

12. The training boot of claim 9 wherein a receptacle fastening member is disposed on the training boot, configured and arranged for attaching a resistance band.

13. The training boot of claim 12 wherein the receptacle fastening member is disposed on the boot upper.

14. The training boot of claim 9 comprising a sensor housing disposed on the boot upper.

15. The training boot of claim 14 comprising a sensor disposed in the sensor housing.

16. The training boot of claim 14 wherein the sensor housing is configured and arranged to receive interchangeable sensors.

17. The training boot of claim 9 comprising a sensor housing disposed in the front bottom sole.

18. The training boot of claim 17 comprising a sensor disposed in the sensor housing.

19. The training boot of claim 17 wherein the sensor housing is configured and arranged to receive interchangeable sensors.

20. The training boot of claim 9 comprising a weight disposed in the weight housing.

21. The training boot of claim 9 wherein the weight housing is configured and arranged to receive interchangeable weights.

22. The training boot of claim 9 comprising a plurality of attachment rings or hooks disposed on the front bottom sole.

23. The training boot of claim 9 comprising a tread on the bottom of the front bottom sole.

24. The training boot of claim 23 wherein the tread is interchangeable.

25. The training boot of claim 9 wherein the front bottom sole is between one and two inches greater in thickness in the location of a ball of a foot, relative to the thickness of any portion of the front bottom sole extending in the location of a heel of the foot.

26. A training boot system comprising:

two training boots of claim 9, one training boot configured for a left foot and the other training boot configured for a right foot; and a resistance band or cord having one end removably attached to one training boot and another end of the resistance band or cord removably attached to the other training boot.

27. The training boot system of claim 1 wherein the boot upper is comprised entirely of a mesh material.

28. The training boot system of claim 1 wherein the weight housing is disposed above the location of the ankle bone.

29. The training boot system of claim 1 wherein the sensor housing is disposed above the location of the ankle bone.

30. The training boot system of claim 1 wherein the front bottom sole is located beneath an area for toes and toe mounds and terminates at the most forward portion of an inner arch of the foot.

31. The training boot system of claim 1 further comprising a sensor disposed in the front bottom sole and configured and arranged to send sensed information to a device deposited in the sensor housing.

32. The training boot system of claim 1 wherein the front bottom sole:

resides beneath an outer little toe mound and an inner big toe mound, is configured and arranged to elevate and support the outer little toe mound and the inner big toe mound, and does not provide support or elevation to an outer heel and an inner heel.

33. The training boot of claim 9 wherein the weight housing is disposed above the location of the ankle bone.

34. The training boot of claim 9 wherein the sensor housing is disposed above the location of the ankle bone.

35. The training boot of claim 9 wherein the front bottom sole is located beneath an area for toes and toe mounds and terminates at the most forward portion of an inner arch of the foot.

36. The training boot of claim 9 further comprising a sensor disposed in the front bottom sole and configured and arranged to send sensed information to a device deposited in the sensor housing.

37. The training boot of claim 9 wherein the front bottom sole:

resides beneath an outer little toe mound and an inner big toe mound, is configured and arranged to elevate and support the outer little toe mound and the inner big toe mound, and does not provide support or elevation to an outer heel and an inner heel.

* * * * *